US005525965A

United States Patent [19]

Liebenthal

[11] Patent Number: 5,525,965

[45] Date of Patent: Jun. 11, 1996

[54] APPLIANCE THEFT PREVENTION ALARM

[75] Inventor: Benjamin C. Liebenthal, Three Rivers, Mich.

[73] Assignee: CRG Enterprises, Inc., Monmouth, Ill.

[21] Appl. No.: 409,134

[22] Filed: Mar. 23, 1995

[51] Int. Cl.[6] ..... G08B 13/14

[52] U.S. Cl. ..... 340/568; 340/571; 340/687; 340/693; 340/652

[58] Field of Search ..... 340/568, 571, 340/687, 538, 691, 693, 635, 636, 652

[56] References Cited

U.S. PATENT DOCUMENTS

| | | | |
|---|---|---|---|
| 2,913,712 | 11/1959 | Lee | 340/280 |
| 3,090,948 | 5/1963 | Cremer | 340/280 |
| 3,484,775 | 12/1969 | Cline | 340/568 |
| 3,959,790 | 5/1976 | Schuyler | 340/568 |
| 4,002,397 | 1/1977 | Wang et al. | 340/568 |
| 4,097,843 | 6/1978 | Basile | 340/687 |
| 4,121,201 | 10/1978 | Weathers | 340/568 |
| 4,195,290 | 3/1980 | Magil et al. | 340/568 |
| 4,237,450 | 12/1980 | Canez | 340/571 |
| 4,584,570 | 4/1986 | Dotson | 340/568 |
| 4,855,719 | 8/1989 | Posey | 340/568 |
| 4,935,725 | 6/1990 | Turnau | 340/568 |
| 4,959,635 | 9/1990 | Wilson | 340/568 |
| 5,258,744 | 11/1993 | Zeder | 340/568 |
| 5,293,115 | 3/1994 | Swanson | 324/110 |

*Primary Examiner*—Brent A. Swarthout
*Assistant Examiner*—Benjamin C. Lee
*Attorney, Agent, or Firm*—Laura Beth Miller

[57] ABSTRACT

A device to prevent the theft of electrical appliances in which the electrical plug of the appliance is plugged in and secured within the device, thereby making the device an integral part of the appliance. The device is plugged into a wall outlet or power strip and the power is connected directly to the appliance. The device incorporates an internal power source, such as a battery, and an alarm connected in series so that the alarm will be activated if the device is unplugged from the electrical outlet. Since the device is securely attached to the appliance it will discourage an attempt to carry it away.

11 Claims, 1 Drawing Sheet

APPLIANCE THEFT PREVENTION ALARM

FIELD OF THE INVENTION

This invention relates generally to alarm devices which signal the removal of an appliance from its source of electrical power. More particularly, it relates to alarm devices which can be easily attached to the appliance without altering the appliance and without special skill, but which cannot be readily removed without triggering an alarm.

BACKGROUND OF THE INVENTION

Electrical appliances such as stereos, television, computers, video recorders, and similar home electronics, are vulnerable to being stolen from unprotected rooms, such as those in college dormitories, apartments, homes and offices. A number of inventions have been devised to deter theft, but they each have drawbacks, which are overcome by the present invention.

For instance, alarms have been devised that require the device to be mounted on or in the appliance. Such devices are disclosed in U.S. Pat. Nos. 4,237,450 to Canez. Utilization of these devices, however, require some manual proclivity. Also, some appliances do not provide a convenient place to mount an alarm device, and some appliances are too small to make these devices practical. Moreover, mounting an alarm device to the appliance will disfigure it with mounting holes.

Other inventions, including the Canez invention, are also disadvantageous because they require the user to break into the electrical circuit of the appliance and alter the electrical connections of an appliance. Such a procedure requires some aptitude on the part of the user and can be unsafe. Other inventions, such as that disclosed in U.S. Pat. No. 4,002,397 issued to Magil, are not secured to the appliance, and therefore, can be easily removed.

Another class of prior art alarm devices are intended for commercial use to prevent shoplifting. Such devices are disclosed in U.S. Pat. No. 2,913,712 issued to Lee and U.S. Pat. No. 4,935,725 issued to Turnau. In general, these devices sound an alarm if the appliance is unplugged. A significant drawback of these devices, however, is that the alarm is at a fixed location within the store and not a part of the appliance, making them unsuitable for dormitories, apartments, or business offices where a thief can rapidly escape the sounding alarm.

There is thus a need for an alarm device that is compact, easy to install, does not disfigure the appliance or break into its electrical circuit, and can be used with any size appliance, yet can be connected to the appliance so as to remain with the appliance should a theft occur, thereby continuing to sound the alarm in emanation from the appliance to indicate the location of the thief and the stolen appliance as it is removed from the premises.

Accordingly, it is an object of the present invention is to provide a simple, efficient and compact device which alerts the owner of an electrical appliance of a pending theft.

Another object of the present invention is to ensure that the alarm device is easy to install without the rewirement of the appliance.

A further object of the present invention is to provide an alarm device that can be used with appliances of all sizes and configurations.

A still further objection of the present invention is to provide an alarm device that remains connected to the appliance in the event of theft and is not easily removable from the electrical appliance without triggering the alarm.

BRIEF SUMMARY OF THE INVENTION

In order to achieve these and other objects of the invention and overcome the problems of the prior art, the improved alarm device of the present invention comprises a housing for enclosing the electrical plug of one or more electrical appliances. The housing provides an electrical connection between the appliance plug and the power source, usually an electrical outlet such as a wall socket or power strip electrically connected thereto. The housing also includes an alarm and a power source for the alarm.

In a preferred embodiment of the invention, the housing has at least one side and at least one opening for passage of an electrical cord; at least one electrical receptacle capable of receiving a standard electrical plug disposed in said housing; a terminal for receiving a battery disposed in said housing; an alarm disposed in said housing; a relay comprising a coil and contacts disposed within said housing, wherein said relay connects the battery terminal, alarm and electrical receptacle within said housing unit causing the alarm to sound when a battery is inserted in the battery terminal and the contacts of said relay are closed; a power terminal, located on one side of the housing and connected to said relay, for receiving alternating current power from an electrical outlet to activate said relay by opening the contacts of said relay; a selectively removable cover for said housing; and screws or other fasteners to secure said cover to said housing, thereby preventing the removal an electrical plug positioned within the electrical receptacle of said housing from said housing.

As an added feature, the cover can be made accessible only from the side of the housing on which the power terminal is located so that the cover cannot be removed without unplugging the device from the electrical outlet, which would activate an alarm. The cover is secured by any fastening means, but preferably by screws, and even more preferably, screws of a special design requiring a noncommon screw driver, and the screw holes filled, to prevent easy disabling of the alarm.

In its normal application, the device is operated by removing the cover from the housing and inserting the plug of an electrical appliance into the electrical receptacle inside the housing of the device. The cover is then secured. Once secured, the cover serves to secure the electrical plug within the housing, thereby impeding a thief's ability to separate the device from the appliance plug without damaging the appliance cord. The device is activated by plugging it into a wall outlet, or power supply, of alternating current (AC) power.

The AC power is transmitted directly from the wall outlet to the plug of the electrical appliance. The AC power is also connected to the coil of a relay within the device. Included within the relay circuit is a battery, an alarm and relay contacts which are normally closed. Thus, when the device is plugged into the wall socket, the AC power energizes the relay, opening the normally closed contacts, thereby disconnecting the battery and alarm. An interruption in the power supply, such as when the device is unplugged from the wall outlet, will cause the relay to de-energize, whereupon the relay contacts will return to their normally closed position to complete the circuit between the battery and the alarm, thereby activating the alarm.

A feature can be included to permit the user to disable the alarm by various options such as a key-operated switch, a key coded contact or a hidden switch. Any one of these options can be connected in series with the battery and the alarm to allow the alarm to be deactivated by the user.

The relay can be an electromechanical, electronic, or electronic circuit.

Accessory circuits, not central to the invention, can be incorporated in the device. Provision for battery charging and a low-battery-voltage alert are examples of such accessory circuits.

DETAILED DESCRIPTION OF THE PREFERRED EMBODIMENTS

Figure 1:
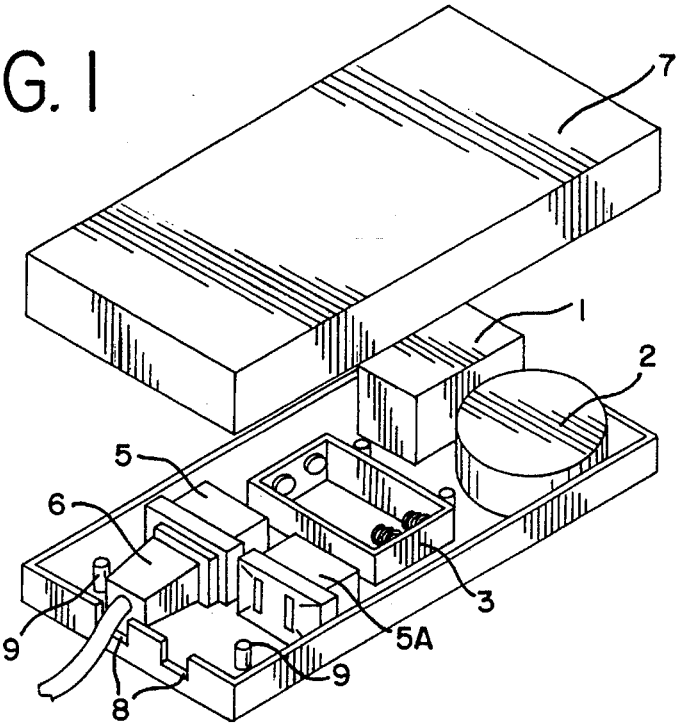
FIG. 1 is a perspective view of an embodiment of an alarm device of the present invention, with the cover removed.

The preferred embodiment of the present invention comprises a housing for enclosing an electrical plug of an appliance, further comprising a power terminal 11 for receiving alternating current from an external power supply such as a wall outlet or power strip 14, a cover 7, at least one electrical receptacle 5, an alarm 2, a relay 1, a terminal for receiving an internal power source such as a battery 3, and at least one opening 8.

When the alarm device is plugged into an electrical outlet, the AC power energizes the relay 1, opening the normally closed relay contact 12 of the circuit. In that state, the circuit between the battery terminal 3 with a battery inserted and the alarm 2 is open and no alarm signal is generated. This is the normal operating state of the device. In this state, the electrical receptacle 5 into which the plug 6 from the electrical appliance to be protected is inserted is in the same circuit as the relay. The device may incorporate more than one electrical receptacle, as illustrated by the second electrical receptacle 5A in FIG. 1.

Figure 2:
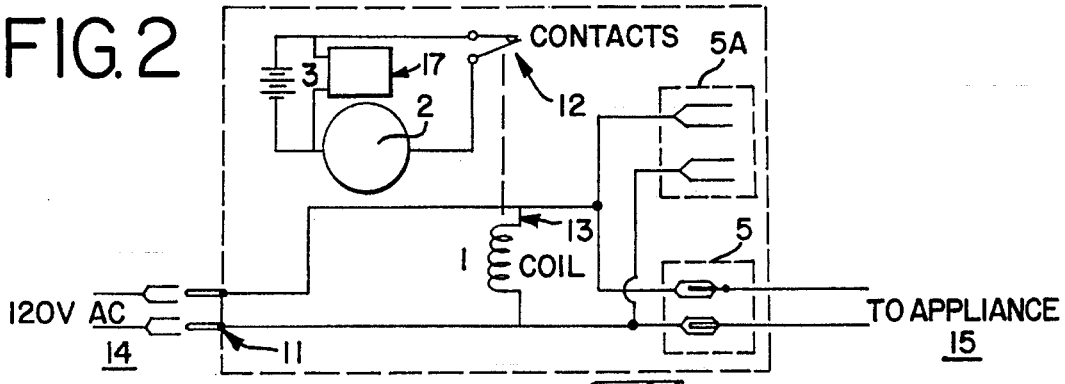
FIG. 2 is a schematic diagram of an embodiment of a relay circuit, and an embodiment of an accessory circuit, of the present invention.

The preferred circuit of the present invention is shown in the schematic diagram of FIG. 2. The circuit connects an external AC power supply 14, such as a wall socket or power strip, an appliance 15 and a relay 1. The relay comprises a coil 13, contacts 12, an alarm 2, and a terminal for receiving a battery 3, connected in series. The relay 1 is normally closed as shown at 12. This schematic diagram of FIG. 2 represents the circuit when the device is unplugged from a wall outlet, as would be the case if it were removed by a thief or by the user to test its operation. In this state, the normally closed contact 12 of the relay 1 completes the circuit from the battery terminal 3 to the alarm 2. In this closed circuit state, the alarm sounds, signaling an unauthorized disconnection of the device from the wall outlet. If the device is unplugged by the owner to test its operation, the signaling of the alarm indicates proper operation of the device to the user.

In its most simple form the relay 1 is a common, 120 volt, AC relay available from many sources. The battery terminal 3 accepts a 9 volt battery of the type normally used in transistor radios, and, the alarm 2 is a voice alarm or a piezoelectric horn with an oscillator driving circuit similar to that used in domestic smoke detectors.

As depicted in FIG. 1, a plug 6 from an appliance is inserted into the electrical receptacle 5 of the device and a battery is inserted in the battery terminal 3. As described above, a second electrical receptacle 5A can accept a plug from a second appliance. The appliance cord exits the housing through a opening 8 in the housing. A cover 7 is secured to the housing, thereby enclosing the plug 6 within the housing and preventing its removal. Preferably, the cover is secured with screws or similar fasteners 9.

Figure 3:
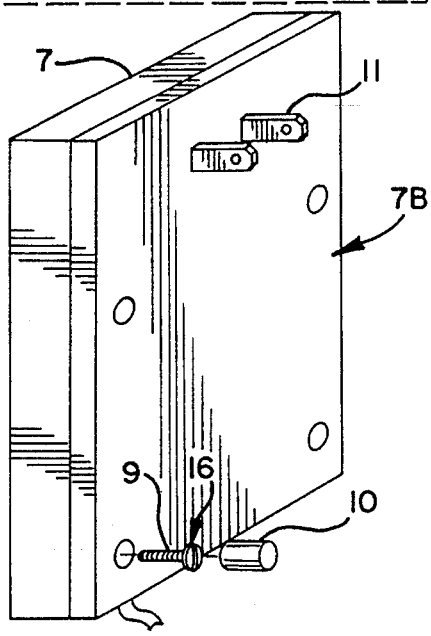
FIG. 3 is a perspective view of the wall side of the assembled device of FIG. 1.

An additional feature of the invention, as depicted in FIG. 3, further deters removal of the appliance plug from the device by positioning all of the fasteners 9 on the same side of the device 7B as the power terminal 11, thus making the screws inaccessible without unplugging the device and activating the alarm. In the preferred embodiment, the screw heads 16 do not accept normal screwdrivers, and preferably, after inserting the screws, the screw holes are filled with a plug 10, making it increasingly difficult and time consuming for an unauthorized person to remove the electrical plug or disengage the device.

The device may be further improved by the addition of accessory circuits 17, such as a battery charging circuit or a low battery alert circuit as depicted in FIG. 2.

While a simple, preferred embodiment of the invention has been described, it should be understood that the invention is not so limited and modification may be made without departing from the spirit or essential characteristics of the invention. The scope of the invention is defined by the appended claims, and all devices that come within the meaning of the claims, either literally or by equivalence, are intended to be embraced therein.

I claim:

1. An alarm apparatus for an electrical appliance having an electrical power plug, comprising:

(a) a housing for enclosing said electrical power plug, said housing having at least one side and at least one opening for passage of an electrical cord of said electrical power plug but not said power plug;

(b) at least one electrical receptacle for receiving said electrical power plug disposed in said housing;

(c) a terminal for receiving a battery disposed in said housing;

(d) an alarm disposed in said housing;

(e) a relay comprising a coil and contacts disposed within said housing, wherein said relay connects the battery terminal, alarm and electrical receptacle within said housing, causing the alarm to sound when said battery is inserted in the battery terminal and the contacts of said relay are closed;

(f) a power terminal, located on one side of the housing and connected to said relay, for receiving alternating current power from an electrical wall outlet to activate said relay by opening the contacts of said relay;

(g) a selectively removable cover for said housing; and (h) fastening means, located on said one side including said power terminal, to secure said cover to said housing, thereby preventing the removal of said electrical power plug positioned within the electrical receptacle of said housing from said housing without sounding said alarm.

2. The apparatus of claim 1 wherein said cover is located on the same side of said housing as said power terminal.

3. The apparatus of claim 1 wherein said fastening means require a specially adapted tool for their insertion and removal.

4. The apparatus of claim 1 further comprising a plug inserted over said fastening means to prevent or deter their removal.

5. The apparatus of claim 1 further comprising a battery charging accessory circuit.

6. The apparatus of claim 1 further comprising a low battery alert accessory circuit.

7. The apparatus of claim 1 wherein the alarm signal is a voice alarm.

8. The apparatus of claim 1 wherein the relay is electromechanical or is an electronic circuit.

9. The apparatus of claim 1 wherein the relay includes a disabling switch.

10. An alarm apparatus for an electrical appliance having an electrical power plug, comprising:

(a) a housing for enclosing said electrical power plug, said housing having at least one side and at least one opening for passage of an electrical cord of said electrical power plug but not said power plug;

(b) at least one electrical receptacle for receiving said electrical power plug disposed in said housing;

(c) a terminal for receiving a battery disposed in said housing;

(d) an alarm disposed in said housing;

(e) a relay comprising a coil and contacts disposed within said housing, wherein said relay connects the battery terminal, alarm and electrical receptacle within said housing causing the alarm to sound when said battery is inserted in the battery terminal and the contacts of said relay are closed;

(f) a power terminal, located on one side of the housing and connected to said relay, for receiving alternating current power from an electrical wall outlet to activate said relay by opening the contacts of said relay;

(g) a selectively removable cover for said housing, wherein said cover is located on the same side of said housing as said power terminal; and (h) fastening means to secure said cover to said housing, thereby preventing the removal of said electrical power plug positioned within the electrical receptacle of said housing from said housing without sounding said alarm, wherein said fastening means are located on the same side of said housing as said power terminal.

11. An alarm apparatus for a plurality of electrical appliances each having an electrical power plug, comprising:

(a) a housing for enclosing said electrical power plugs, said housing having at least one side and respective openings for passage of the electrical cords of said electrical power plugs but not said power plugs;

(b) a plurality of electrical receptacles for receiving said electrical power plugs disposed in said housing;

(c) a terminal for receiving a battery disposed in said housing;

(d) an alarm disposed in said housing;

(e) a relay comprising a coil and contacts disposed within said housing, wherein said relay connects the battery terminal, alarm and electrical receptacle within said housing, causing the alarm to sound when said battery is inserted in the battery terminal and the contacts of said relay are closed;

(f) a power terminal, located on one side of the housing and connected to said relay, for receiving alternating current power from an electrical wall outlet to activate said relay by opening the contacts of said relay;

(g) a selectively removable cover for said housing; and (h) fastening means, located on said one side including said power terminal, to secure said cover to said housing, thereby preventing the removal of any of said electrical power plugs positioned within the electrical receptacles of said housing from said housing without sounding said alarm.

* * * * *